United States Patent [19]

Macaulay et al.

[11] 4,089,777

[45] May 16, 1978

[54] HIGH CAPACITY SEPARATOR FOR SEMOLINA

[76] Inventors: Malcolm Jack Macaulay, 1945 Porter, #A56, Wichita, Kans. 67203; Ernesto Simroth L., Mississippi 343 Pte. Colonia del Valle, Garza Garcia, Nuevo Leon, Mexico

[21] Appl. No.: 683,907

[22] Filed: May 6, 1976

[51] Int. Cl.[2] ..... B07B 1/06

[52] U.S. Cl. ..... 209/259; 209/300; 209/283

[58] Field of Search ..... 209/283, 300, 358, 259; 241/73, 74

[56] References Cited

U.S. PATENT DOCUMENTS

| | | | |
|---|---|---|---|
| 811,930 | 2/1906 | Kihlgren | 209/283 |
| 2,258,537 | 10/1941 | Calkins | 241/74 |
| 2,386,021 | 10/1945 | Wetmore | 209/283 |
| 2,822,812 | 2/1958 | Edwards | 209/283 |
| 3,149,065 | 9/1964 | Van Doorn | 209/283 |
| 3,630,458 | 12/1971 | Smiley | 241/73 |

*Primary Examiner*—Hiram H. Bernstein
*Attorney, Agent, or Firm*—Gunn & Lee

[57] ABSTRACT

The present invention relates to a separator commonly used in flour mills. The grain is crushed by rollers and fed to the present apparatus for separation of a coarse product from a fine product. A drum section has stationary hammers extending from one end and rotating hammers extending from the other end. The rotating hammers are attached to a plate turned by a motor with the rotating hammers moving through the stationary hammers. This causes the crushed grain to be sifted through a perforated screen with the fine product feeding through an outlet for the fine product. The coarse product accumulates and spills over an upper edge of the perforated screen to feed through an outlet for the coarse product. The screen or its position, may be changed to vary the discharge from the present apparatus.

7 Claims, 3 Drawing Figures

HIGH CAPACITY SEPARATOR FOR SEMOLINA

BACKGROUND OF THE INVENTION

The present invention relates to a separator for separating a coarse product from a fine product and, more particularly, a high capacity separator for use in a flour mill. The fine product (normally including the flour and semolina) is separated from the coarse product (normally including husk and bran with or without flow particles attached thereto) by means of rotating hammers and stationary hammers causing the crushed flour to sift through a perforated screen. The coarse product accumulates until it falls over an upper edge of the screen to an outlet for the coarse product.

BRIEF DESCRIPTION OF THE PRIOR ART

Prior to the present invention, flour mills have used very complicated and expensive apparatus in the milling of grain for the purpose of separating flour and semolina from husk and bran. Even with the expensive machinery, the present flour mills do not have separators that can handle the high volume or capacity as can the present invention. The common practice was and still is to feed the broken or crushed grain from a set of first brush rollers to a box-like sifter. The crushed grain was sifted through a series of screens to separate the different size particles with each screen being emptied as it fills. Millers originally shook sieves by hand. A cloth sifter was commonly used during sifting process to produce a very fine flour.

While cylindrical reels have been used, the flat sifters were normally more efficient. The flat sifters were on an incline with the crushed grain being introduced at the top. Due to vibrations of the of a very fine mesh. Because the screen would become coarser toward the bottom, coarser particles would fall through as vibrations caused the crushed grain to move down the screen. The larger particles which remain may be recrushed to recover any flour still attached thereto. Four or five additional crush rolls may be used in a typical flour mill with additional separators being used after each crushing of the grain particles. Air currents are commonly used to aid the sifting action of the screen.

Another term commonly used for the entire sifter is "purifier" and the screen itself is commonly called a "sieve." It should be realized that the initial sifting is for size separation, rather than strictly separation of bran or wheat germ removal. The crushed grain is divided into coarse middling, fine middling and flour. The coarse middlings are returned to the coarse rolls and the fine middlings are delivered to fine rollers. A "plansifter" is commonly used for the size grading, rather than the previously mentioned purifier.

SUMMARY OF THE INVENTION

It is an object of the present invention to provide a high capacity separator which will separate the coarse product from the fine product after a grain is crushed during the milling process.

It is another object of the present invention to fed crushed grain into the present apparatus for separation of the coarse product from the fine product. The present separator has a series of stationary hammers with a series of rotating hammers rotating therebetween to cause agitation of and discharge of the fine product through a perforated screen. The discharge of the coarse product is over one edge of the screen thereby separating the coarse product from the fine product.

It is yet another object of the present invention to provide a high capacity separator which has a drum section with a perforated screen therebelow. Stationary hammers extend from one end of the drum section which receives the crushed grain. Rotating hammers located on a rotating plate turn between the stationary hammers. A perforated screen encircles the lower portion of the drum section containing the hammers. The fine product, due to the agitation of the rotating hammers, sifts through the perforated screen with the coarse product being discharged over one edge of the screen, thereby separating the coarse and fine product.

It is yet another object of the present invention to provide an apparatus for separating fine products, such as flour and semolina, from the coarse products after the crushing of the grain. The crushed grain feeds into a drum section which has stationary hammers extending from one end and rotating hammers carried on a plate at the other end of the drum section. A perforated screen surrounds the hammers and is adjustable with respect to the hammers. This controls the amount of fine product flowing through the perforated screen, and the amount of coarse product flowing over an upper edge of the screen. The fine product is discharged through one outlet with the coarse product being discharged through another outlet.

DESCRIPTION OF THE PREFERRED EMBODIMENT

Figure 1:
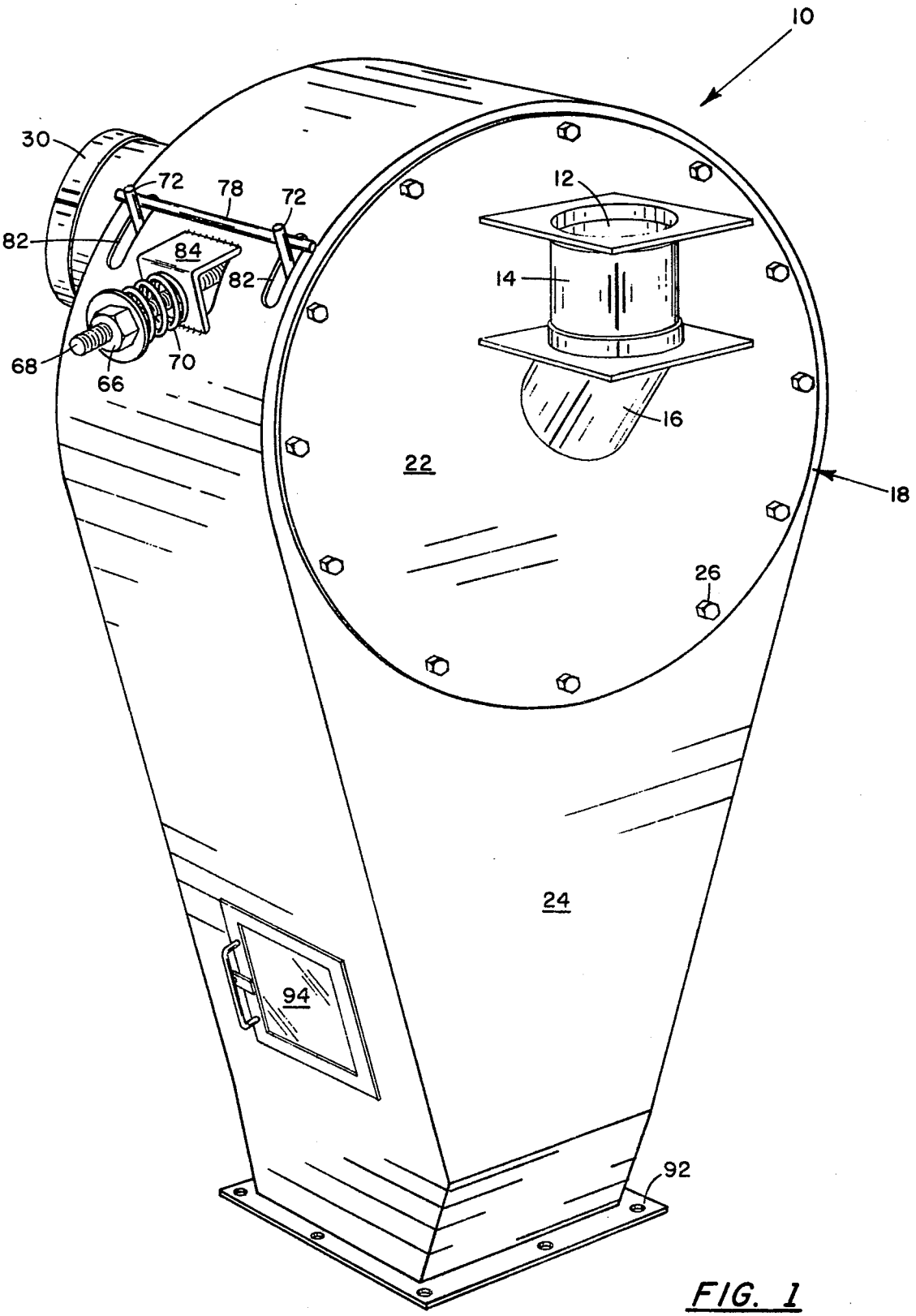
FIG. 1 is a perspective view of the high capacity separator.

Referring now to FIG. 1, there is shown a high capacity separator for separating the coarse and fine product in a flour mill with the separator being referred to generally by reference numeral 10. Crushed grain is received from the roller portion of the mill through inlet opening 12 of conduit 14. Conduit 14 has an angle portion 16 which feeds into the center of the barrel-shaped drum section 18.

Figure 2:
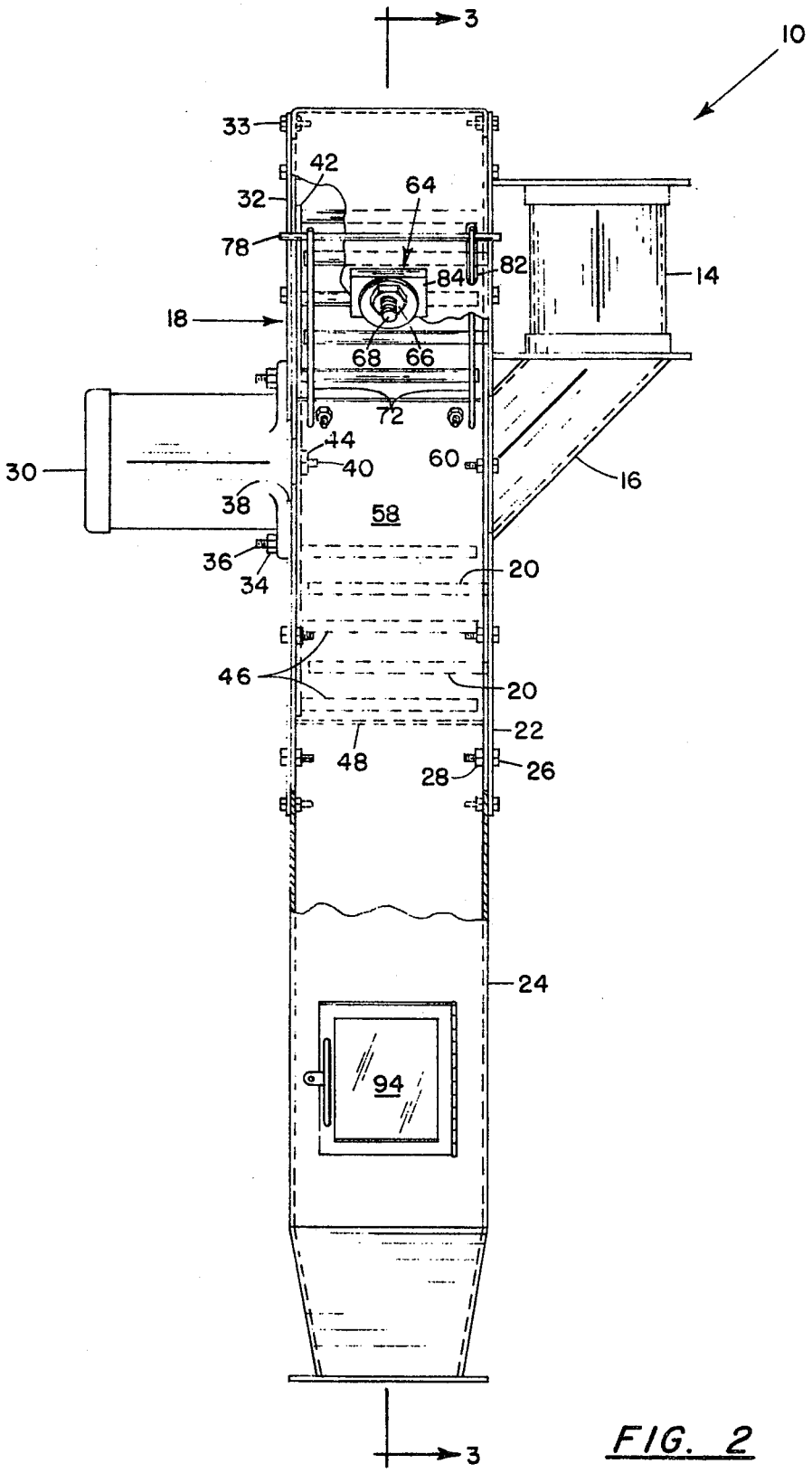
FIG. 2 is an elevated side view of FIG. 1 with a partial cutaway section to better illustrate the internal portions of the separator.
Figure 3:
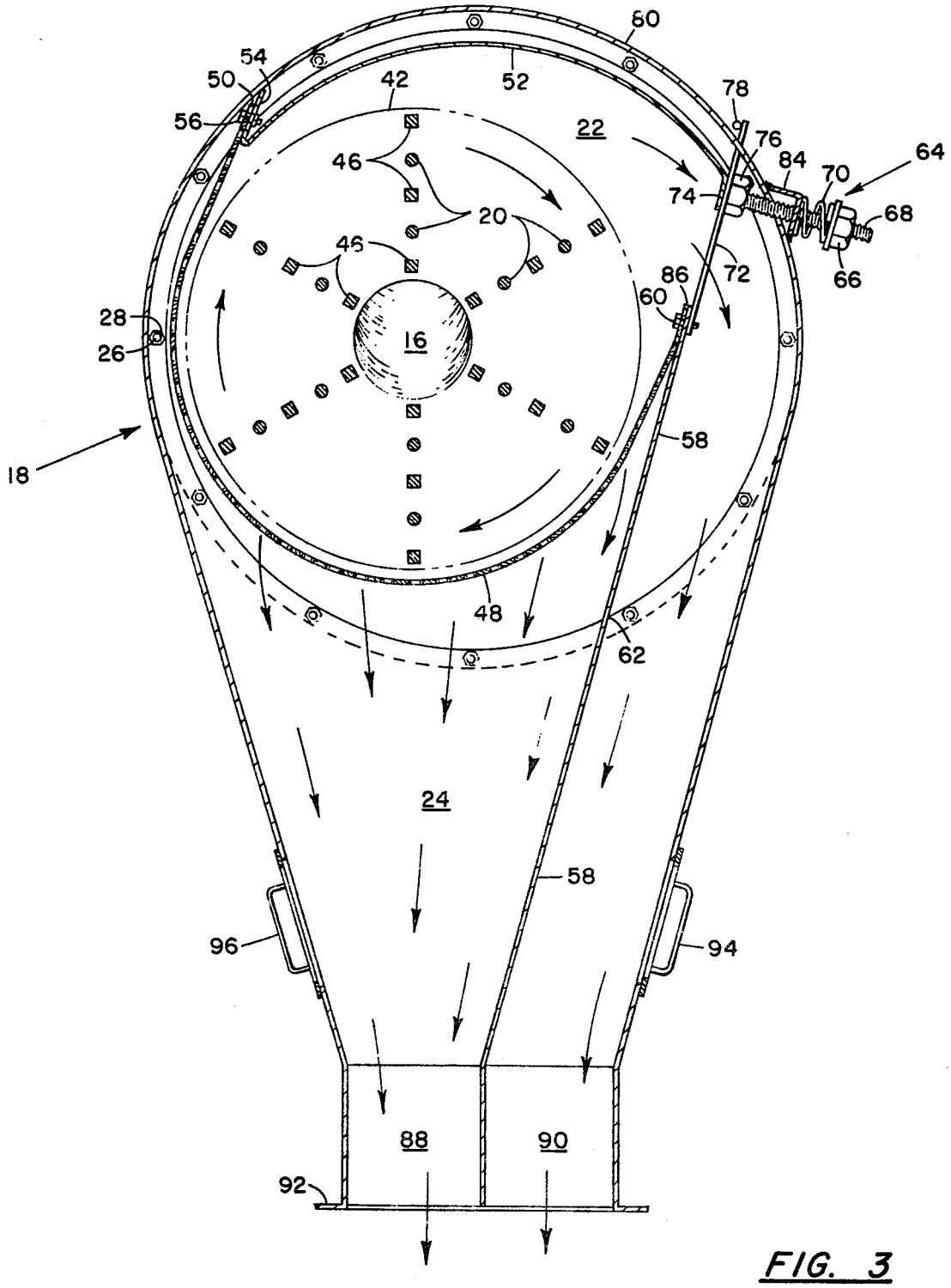
FIG. 3 is a cross-sectional view of FIG. 2 along section lines 3—3.

Referring now to FIGS. 1, 2 and 3 in combination, the internal structure of the high capacity separator 10 can be better understood. Inside of the drum section are located a series of stationary hammers 20 that are connected to drum plate 22. Drum plate 22 receives the crushed grain via angle conduit 16 at approximately the center of the stationary hammers 20. The drum plate 22 is connected to housing 24 by means of bolts 26 and nuts 28. As can be seen in FIG. 3, the stationary hammers 20 are circular rod projections extending from the drum plate 22 to almost the other side of the drum section 18.

On the opposite side of the drum section 18 is located a motor 30 connected to a motor plate 32 by means of nuts 34 and bolts 36. The motor plate 32 is connected to housing 24 by bolts 33. An opening 38 is provided in motor plate 32 to receive the rotating shaft 40 of the motor 30 therethrough. The rotating shaft 40 of the motor 30 is attached to a rotating plate 42 by means of lock nut 44. The rotating plate 42 is shown in reference lines in FIG. 3. On the rotating plate 42 are located a series of rotating hammers 46. As can be more clearly seen in FIGS. 2 & 3 the rotating hammers 46 are square rods extending from the rotating plate 42 to almost the other side of drum section 18.

The rotating plate 42 will turn if the motor 30 is running to turn shaft 40. The rotating hammers 46 are spaced so that they may rotate through the stationary hammers 20 without touching the stationary hammers 20.

Surrounding the rotating plate 42 is located a perforated screen 48 having a semi-permanent shape. The perforated screen 48 extends from an abutting relationship with the drum plate 22 to an abutting relationship with motor plate 32. End 50 of the perforated screen 48 is attached to flange 54 of screen plate 52 by means of bolts 56. The screen plate 52 is attached to housing 24 via flange 54 by any convenient means such as welding. The opposite end of perforated screen 48 is attached to dividing wall 58 by means of bolts 60. Bolts 56 and 60 may be countersunk to prevent the boltheads from interfering with the normal operation of the high capacity separator 10.

The dividing wall 58 is secured to housing 24 up to point 62 by any convenient means such as welding. Beyond point 62 dividing wall 58 simply abuts drum plate 42 and motor plate 32. Since dividing wall 58 and spring plate 52 are somewhat flexible, adjustment of the regulating valve 64 will control the position of the perforated screen 48 with respect to the rotating plate 42. Dividing wall 58 connects to regulating valve 64 via rods 72. Rods 72 are connected to dividing wall 58 by any convenient means such as welding. The regulating valve 64 is adjusted by turning nut 66 on bolt 68. Spring 70 exerts a constant force on the rods 72. The spring plate 52 has a flange 74 that is connected to rods 72 and bolt 68 by any convenient means such as welding. To give additional strength to bolt 68, stationary nut 76 is welded to flange 74. Cross rod 78 is also connected to rods 72 outside of the housing 24.

By the loosening of nut 66 of regulating valve 64, the compressive force exerted on spring 70 will be reduced. However, because of spring force exerted by spring plate 52, spring plate 52 will move towards the top 80 of the high capacity separator 10. This movement of the spring plate 52 towards the top 80 will cause the perforated screen 48 to be moved upward the rotating hammers 46. Simultaneously, the portion of the dividing wall 58 above point 62 will move inward toward the rotating hammers 46 as the bolt 68 moves to the left (see FIG. 3.) It should be realized that the rods 72 are free to move along slots 82 in the housing 24 as the spring plate 52 moves. The spring 70 in combination with spring plate 52 controls the position of the rods 72. The force of the spring 70 acts against bracket 84 of housing 24.

By tightening nut 66, dividing wall 58 will be drawn to the right (see FIG. 3) and spring plate 52 will be moved away from top 80. This will cause the dividing wall 58 to partially close the opening between dividing wall 58 and housing 24 to control the amount of discharge of coarse product thereabove.

In case of problems such as stoppage inside of the separator 10, inspection doors 94 or 96 may be opened. Inspection door 94 connects to the discharge flue 90 for coarse product, and inspection door 96 connects to the discharge flue 88 for fine product.

METHOD OF OPERATION

The crushed grain feeds into the high capacity separator 10 via conduit 14 and is received inside of the barrel-shaped drum section 18. Motor 30 turns rotating plate 42 which carries the rotating hammers 46 thereon. Movement of the rotating hammers 46 through the stationary hammers 20 agitates the crushed grain inside of the drum section 16. The fine product such as flour or semolina will fall through the perforations in perforated screen 48. As the coarse product accumulates inside of drum section 18, it will reach a level approximately equal to the top 86 of dividing wall 58. Thereafter, further accumulation of coarse product, such as husk or bran that will not fall through the holes in the perforated screen 48, will spill over the top of dividing wall 58. The fine product falling through the holes in the perforated screen 48 continues to fall through flue 88. Simultaneously, the coarse product which discharges over the top 86 of dividing wall 58 will discharge through flue 90. Additional conduits (not shown) may be connected to flues 88 and 90 by means of flange 92 for transporting the coarse or fine product to its desired location. The coarse product may be returned to the mill for recrushing so that additional flour or semolina may be collected therefrom. The fine product such as flour or semolina may be transported to additional sections of the mill for an additional processing.

It should be understood that the perforated plate 48 may be interchanged with other perforated plates having a different size of holes therein depending upon the coarseness or fineness desired.

In a typical mill, a series of high capacity separators 10 may be used by separating large quantities of flour and semolina from the coarse product. Also, different separators may be used to give a product having a different coarseness or fineness of products from other separators.

We claim:

1. A separator for use in a flour mill for separating a coarse and fine product from crushed grain, said separator comprising:

a housing for said separator;

a drum section in said housing having an opening in a first end thereof for receiving crushed grain;

stationary hammers connecting to said first end;

rotating plate means having rotating hammers thereon, said rotating plate means being adjacent a second end of said drum section, said rotating hammers extending to close proximity with said first end and said stationary hammers extending to close proximity with said rotating plate means;

drive means extending into said drum section for turning said rotating plate means, said rotating hammers rotating between said stationary hammers to agitate said crushed grain received in said drum section;

dividing wall means extending downward from one side of said drum section, a second end of said arcuate screen means being attached to said dividing wall means;

flue means having at least two channels, a first channel of said flue means being located below said arcuate screen for receiving a fine product of said crushed grain falling through said arcuate screen, a second channel of said flue means receiving a coarse product of said crushed grain that falls over a top of said dividing wall means, said top being near the same plane as the rotating axis of said rotating plate means.

2. The separator as given in claim 1 wherein said drive means includes a shaft of a motor means extending through said second end, said shaft connecting to said rotating plate means, said shaft and rotating plate means being turned by said motor means.

3. The separator as given in claim 2 wherein said dividing wall means and said arcuate screen means are partially movable to regulate the amount of coarse and fine product received from said separator.

4. The separator as given in claim 3 includes a means for adjusting said arcuate screen means and said dividing wall means by adjustments external to said separator, said adjustments of said arcuate screen means and said dividing wall means being relative to said rotating plate means.

5. The separator as given in claim 4 wherein said arcuate screen means and said dividing wall means are partially flexible for said adjustments.

6. The separator as given in claim 1 wherein said stationary hammers are circular rod-like extensions extend from said first end of said drum section to adjacent rotating plate means, and said rotating hammers are square rod-like extensions extend from said rotating plate means to adjacent said first end.

7. The separator as given in claim 5 wherein said top of said dividing wall means connects to said adjusting means by rods extending through slots near a top of said drum section, movement of said rods moving said arcuate screen means and said dividing wall means.

* * * * *